US007975710B2

(12) United States Patent
Lai et al.

(10) Patent No.: US 7,975,710 B2
(45) Date of Patent: Jul. 12, 2011

(54) ACOUSTIC CLEANING SYSTEM FOR ELECTRONIC COMPONENTS

(75) Inventors: Hon Keung Lai, Ma On Shan (HK); Hoi Shuen Tang, Kwai Chung (HK); Wang Lung Tse, North Point (HK)

(73) Assignee: ASM Assembly Automation Ltd, Hong Kong (HK)

( * ) Notice: Subject to any disclaimer, the term of this patent is extended or adjusted under 35 U.S.C. 154(b) by 0 days.

(21) Appl. No.: 12/497,842

(22) Filed: Jul. 6, 2009

(65) Prior Publication Data

US 2011/0000503 A1 Jan. 6, 2011

(51) Int. Cl.
*B08B 3/00* (2006.01)
*B08B 3/12* (2006.01)
*B08B 6/00* (2006.01)

(52) U.S. Cl. ..... 134/135; 134/184; 134/902

(58) Field of Classification Search ..... 134/135, 134/184, 902

See application file for complete search history.

(56) References Cited

U.S. PATENT DOCUMENTS

| | | | | |
|---|---|---|---|---|
| 4,955,402 | A * | 9/1990 | Miranda | 134/107 |
| 5,339,842 | A * | 8/1994 | Bok | 134/1 |
| 5,601,655 | A * | 2/1997 | Bok et al. | 134/1 |
| 6,446,354 | B1 | 9/2002 | Na | |
| 2004/0123878 | A1 * | 7/2004 | Cheng et al. | 134/1 |
| 2009/0038638 | A1 * | 2/2009 | Cheng et al. | 134/1.3 |

* cited by examiner

*Primary Examiner* — Michael Barr
*Assistant Examiner* — Charles W Kling
(74) *Attorney, Agent, or Firm* — Ostrolenk Faber LLP

(57) ABSTRACT

An apparatus for cleaning electronic packages comprises a tank containing cleaning fluid and a holder above the tank that supports the electronic packages above a top surface of the cleaning fluid with the electronic packages facing the cleaning fluid. Acoustic energy generators are immersed in the cleaning fluid for generating and propagating acoustic energy towards the top surface of the cleaning fluid to create streaming fluid jets projecting upwardly at the top surface to contact and clean the electronic packages supported on the holder.

19 Claims, 5 Drawing Sheets

ACOUSTIC CLEANING SYSTEM FOR ELECTRONIC COMPONENTS

FIELD OF THE INVENTION

The present invention relates to a system for cleaning electronic components, and in particular, to a fluid jet system using acoustic streaming for aiding the dislodgement of particles on the surfaces of semiconductor devices.

BACKGROUND AND PRIOR ART

Electronic components, such as semiconductor substrates or packaged semiconductor devices in the form of Quad Flat No-Lead (QFN) packages and Chip-Scale Ball Grid Array (CSBGA) packages, usually undergo singulation into separate units after they have been packaged in an array arrangement. After sawing, the molded surfaces of the singulated electronic units will be contaminated with saw residue, such as saw dust and copper traces.

Typically, singulated electronic packages may be cleaned by mechanical agitation. In one prior art U.S. Pat. No. 6,446,354 entitled "Handler System for Cutting a Semiconductor Package Device", a soft brush is used for creating mechanical agitation on the bottom molded surfaces of the packages. This action assists in removing the saw residue by loosening the residue. The brush may be wet when wet brushing is required. Next, high pressure water jets are directed at the bottom molded surfaces of the packages to wash off and remove the loosened saw residue.

There are disadvantages in using a brush for cleaning by mechanical agitation. For example, after a long period of use, some saw residue is trapped in the brush. Periodic maintenance is therefore necessary to keep the brush clean, or otherwise the dirty brush may introduce dirt onto the surfaces to be cleaned instead. The cleaning effect by mechanical agitation will also be largely reduced with a dirty brush. Additionally, since there is actual contact with the molded surfaces of the packages during brushing, care must be taken not to damage the packages. While the brushing force acting on the molded surfaces must be sufficiently large to loosen the saw residue, the force should not be too large to dislodge the packages being held by vacuum on a pickhead during washing. Further, the pressure from the water jets must be sufficiently high for washing off the loosened saw residue but this must not be so large as to dislodge the singulated electronic packages.

To avoid the disadvantages of mechanical agitation, U.S. Pat. No. 5,339,842 entitled "Method and Apparatus for Cleaning Objects" discloses the use of megasonic vibrations to enhance cleaning of electronic packages. Megasonic cleaning uses acoustic frequencies of approximately 800 KHz to 1.8 MHz. Therefore, megasonic cleaning can be highly effective for removing particles having a particle size of about 1 micron or less. In this cleaning method, the bottom surface of a workpiece is cleaned by immersing the workpiece in a first water tank overflowing with water such that the bottom surface of the workpiece is in contact with the surface of the running water while the workpiece is moved through the tank. At the bottom of the water tank, a transducer generates megasonic waves that propagate upwardly through the water to the surface of the water where the workpiece is moving through. The flowing water and the megasonic waves loosen the saw residue on the bottom surface of the workpiece, and the water carrying the loosened saw residue flows into a second water tank surrounding the first water tank to be collected. However, since megasonic vibrations are high frequency waves which are highly focused in nature, only a limited area of the workpiece can be cleaned. To subject the entire workpiece to the cleaning effect of the megasonic vibrations, the routing distance of the workpiece is long and time consuming to implement. Furthermore, the transducer is enclosed by a housing which causes some megasonic energy loss and thus reduces the cleaning effect.

US Publication No. 2009/0038638 A1 entitled "Megasonic Cleaning System" discloses an improvement over the above prior art in that the workpiece is cleaned by a linear arrangement of nozzles, with each nozzle housing a megasonic transducer. Megasonic vibrations are transmitted to each water jet passing through the nozzles. The actuated water jets clean the molded surface of the workpiece with the vibrational energy of the megasonic wave. Relative movement between a pickhead supporting a workpiece and the nozzle assembly with multiple transducers in X and Y axes respectively allow the entire surface of the workpiece to be cleaned expeditiously.

However, his approach has the same disadvantage as with U.S. Pat. No. 5,339,842 in that each transducer is housed within a nozzle body and is enclosed. Some megasonic acoustic energy is lost to the inner surface of the nozzle when the water jet passes through it or when there is a change in directional flow within the nozzle. This reduces the effectiveness of cleaning using the actuated water jets. Furthermore, the size of each nozzle limits the number of nozzles that can be laid out and therefore the number of transducers that can be accommodated in the arrangement of water jets. As a result, the transducers are located relatively far apart, and hence the nozzle assembly needs to travel a longer distance to cover the entire length of the workpiece.

As the nozzles are arranged in a single line, more time is required to move the pickhead through the entire width of the workpiece so that all areas of the workpiece may be cleaned. Thus, while cleaning time is reduced over U.S. Pat. No. 5,339,842, substantial time is still required for moving the pickhead and the nozzle assembly to cover all areas of the workpiece. A faster cleaning process is preferred, particularly when handling larger electronic devices such as BGA devices which require much less singulation time since faster cutting speeds can be achieved and fewer units are being handled. A time-consuming cleaning process will thus cause a more pronounced delay in the in-line operation when handling singulated BGA devices.

Therefore, it would be desirable to achieve a cleaning method for singulated electronic packages which sufficiently cleans the packages without damaging or loosening any singulated units and which can be completed within a shorter time.

SUMMARY OF THE INVENTION

It is thus an object of the invention to seek to provide a method and an apparatus for cleaning singulated electronic packages effectively and quickly with the aid of acoustic energy.

According to a first aspect of the invention, there is provided an apparatus for cleaning electronic packages, comprising: a tank containing cleaning fluid; a holder locatable above the tank which is operative to support the electronic packages above a top surface of the cleaning fluid with the electronic packages facing the cleaning fluid; a plurality of acoustic energy generators immersed in the cleaning fluid for generating and propagating acoustic energy towards the top surface of the cleaning fluid, wherein the acoustic energy creates streaming fluid jets projecting upwardly at the top surface to contact and clean the electronic packages supported on the holder.

According to a second aspect of the invention, there is provided a method for cleaning electronic packages, comprising the steps of: providing a tank containing cleaning fluid; supporting the electronic packages above a top surface of the cleaning fluid with a holder such that the electronic packages face the cleaning fluid; generating and propagating acoustic energy with a plurality of acoustic energy generators immersed in the cleaning fluid towards the top surface of the fluid to thereby create streaming fluid jets at the top surface; and projecting the streaming fluid jets upwardly onto the electronic packages supported on the holder to contact and clean them.

It would be convenient hereinafter to describe the invention in greater detail by reference to the accompanying drawings which illustrate preferred embodiments of the invention. The particularity of the drawings and the related description is not to be understood as superseding the generality of the broad identification of the invention as defined by the claims.

BRIEF DESCRIPTION OF THE DRAWINGS

The present invention will be readily appreciated by reference to the detailed description of the preferred embodiment of the invention when considered with the accompanying drawings, in which.

DETAILED DESCRIPTION OF THE PREFERRED EMBODIMENT OF THE INVENTION

The preferred embodiment of the present invention will be described hereinafter with reference to the accompanying drawings.

Figure 1:
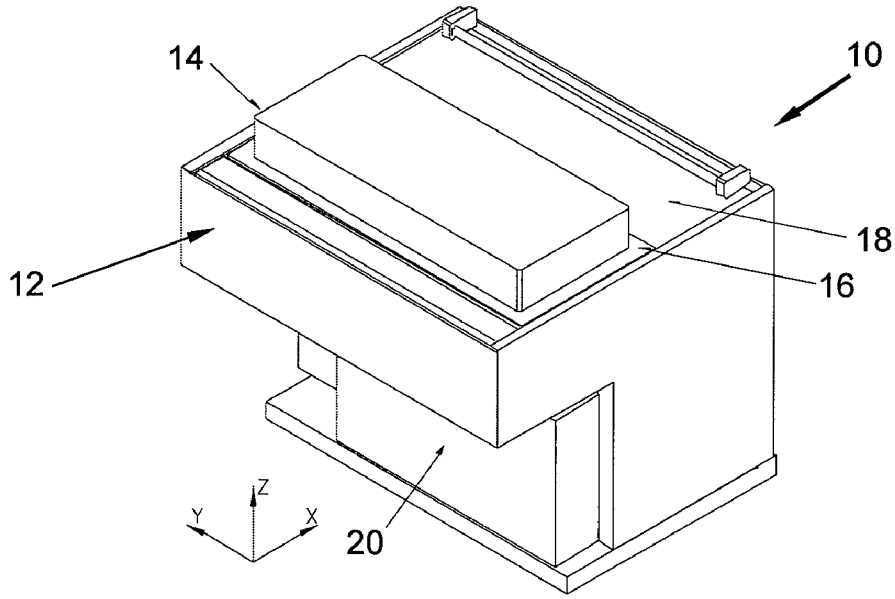
FIG. 1 is an isometric view of a cleaning apparatus for cleaning electronic packages, such as semiconductor packages, according to the preferred embodiment of the invention.

FIG. 1 is an isometric view of a cleaning apparatus 10 for cleaning electronic packages, such as semiconductor packages, according to the preferred embodiment of the invention. The apparatus 10 preferably comprises a cleaning chamber 12 in which cleaning is conducted. A holder in the form of a pickhead 14 is positionable on top of the cleaning chamber 12 and is configured to hold a plurality of semiconductor packages 32 arranged in an array. The apparatus 10 may also comprise a slider mechanism driving a slider plate 16 on which the pickhead 14 is placed or coupled, the slider plate 16 being operable to move with the pickhead 14 along the X-axis. A cover such as a plastic curtain 18 is located adjacent to the slider plate 16 and provides a shield preventing a cleaning fluid such as water from jetting out of the cleaning chamber 12.

Figure 2:
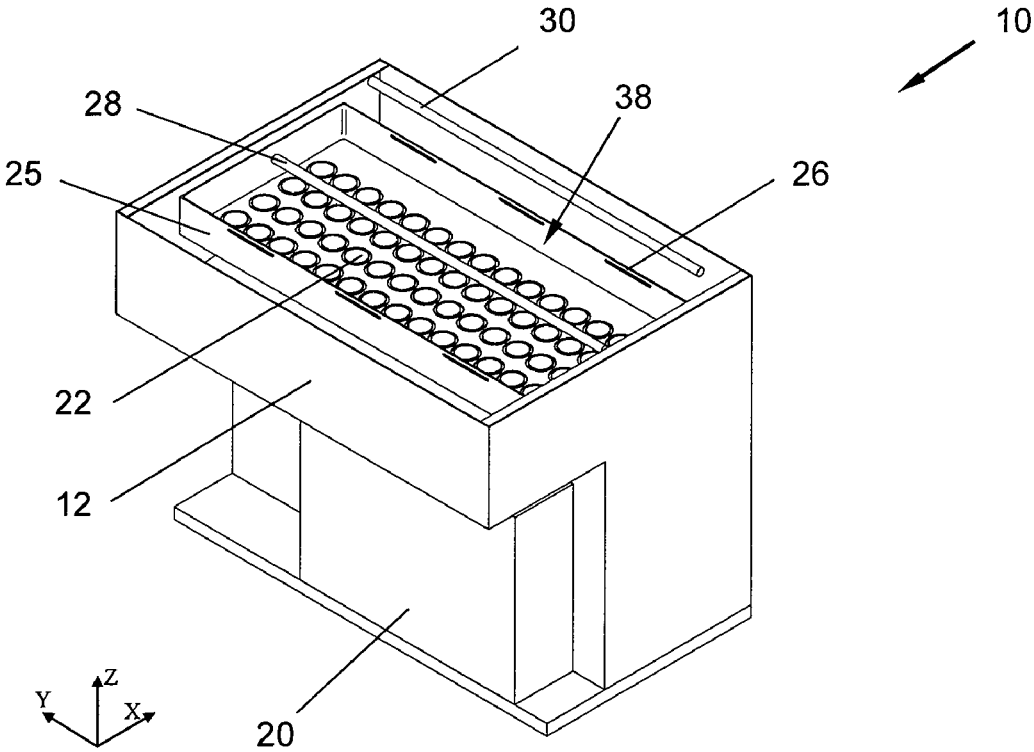
FIG. 2 is an isometric view of the cleaning apparatus of FIG. 1 with its top portion exposed to illustrate an assembly of megasonic transducers arranged in a rectangular formation for generating megasonic waves.

FIG. 2 is an isometric view of the cleaning apparatus 10 of FIG. 1 with its top portion exposed to illustrate acoustic energy generators which may comprise an assembly of megasonic transducers 22 arranged in a rectangular formation for generating megasonic waves. The cleaning chamber 12 houses a tank assembly for containing the cleaning or working fluid 38 in the form of water in a fluid tank 25. The megasonic transducers 22 are immersed in the working fluid 38 and mounted to the bottom of the fluid tank 25, most advantageously in a two-dimensional array. As the megasonic transducers 22 are not enclosed in any housing, each of the megasonic transducers 22 is exposed directly to and is in direct contact with the working fluid 38 in the fluid tank 25.

A driving device 20 may comprise first and second linear driving devices, namely the slider mechanism and a separate driving mechanism respectively, arranged along two orthogonal axes. The driving device 20 drives relative movement between the pickhead 14 and streaming fluid jets generated inside the fluid tank 25. For instance, the driving device 20 may separately drive the slider plate 16 and hence the pickhead 14 along the X-axis, and the fluid tank 25 along the Y-axis perpendicular to the X-axis.

The height of the fluid tank 25 is lower than a top edge of a side wall of the cleaning chamber 12 and the fluid tank 25 is covered by the slider plate 16 during the cleaning process. A plurality of apertures 26 in the form of slots are located along the top end of the fluid tank 25 which permits the working fluid 38 to overflow out of the fluid tank 25 from the apertures 26. Working fluid 38 overflowing from the fluid tank 25 may thus be collected in the cleaning chamber 12. The cleaning chamber 12 has drying devices to speed up drying of the semiconductor packages 32 after cleaning. The drying devices preferably comprise a first dry air tube 28 arranged lengthwise on the fluid tank 25 in the cleaning chamber 12, and a second dry air tube 30 arranged lengthwise away from the fluid tank 25 along a length of the cleaning chamber 12. The first and second dry air tubes 28, 30 blow air onto the semiconductor packages 32 carried on the pickhead 14 in order to dry them.

Figure 3:
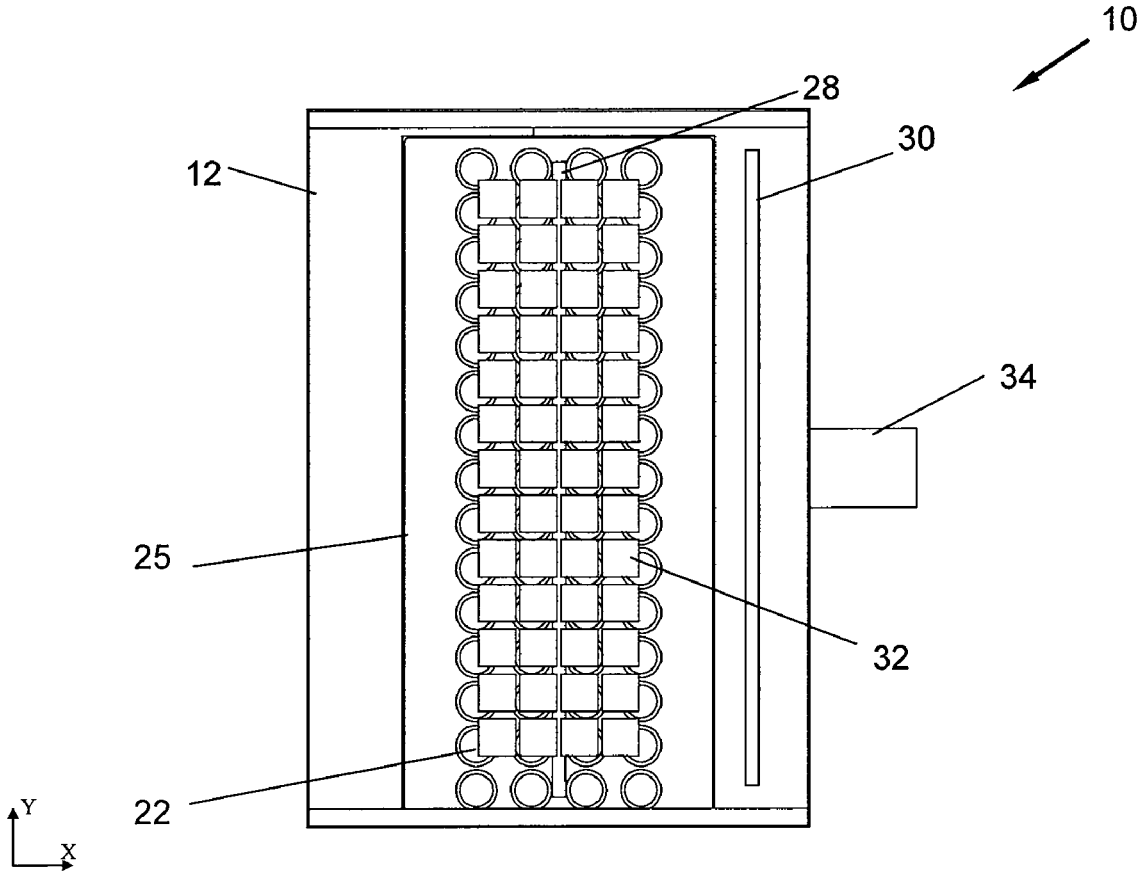
FIG. 3 is a top view of the cleaning apparatus of FIG. 2 illustrating the arrangement of megasonic transducers relative to an array of singulated semiconductor packages to be cleaned.

FIG. 3 is a top view of the cleaning apparatus 10 of FIG. 2 illustrating the arrangement of megasonic transducers 22 relative to an array of singulated semiconductor packages 32 to be cleaned. All the singulated semiconductor packages 32 are positioned above the array of megasonic transducers 22 and the driving device 20 is operative to ensure the semiconductor packages 32 are all locatable within the boundaries of the megasonic transducers 22 for cleaning. The fluid tank 25 may move in a Y direction while the semiconductor packages 32 supported by the pickhead 14 locatable above the fluid tank 25 may move in an X direction to permit the megasonic waves from the megasonic transducers 22 to reach all areas of the semiconductor packages 32. A drainage arrangement 34 extends from the bottom of the cleaning chamber 12 for collecting and draining away processed working fluid 38 which has flowed out from the apertures 26.

Figure 4:
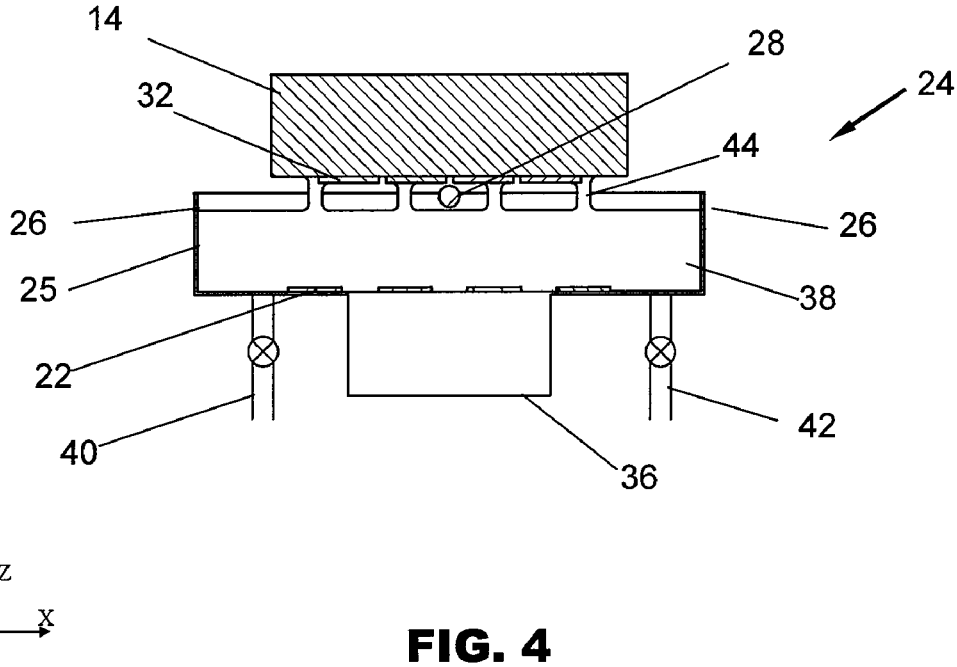
FIG. 4 is a sectional end view of a tank assembly of the cleaning apparatus of FIG. 1.

FIG. 4 is a sectional end view of the tank assembly 24 of the cleaning apparatus 10 of FIG. 1. The tank assembly 24 is operatively linked to the driving mechanism of the driving device 20 which drives the tank assembly 24 in the Y direction. A control circuit of the megasonic transducers 22 is enclosed in a housing 36 mounted to the underside of the bottom of the fluid tank 25 such that the control circuit and the assembly of megasonic transducers 22 are in close proximity to reduce signal loss. The first dry air tube 28 is located in the middle of the fluid tank 25 above the working fluid 38.

The pickhead 14 holds and supports the array of semiconductor packages 32 such that the semiconductor packages 32 are located above a top surface of the working fluid 38 with the molded surfaces directed downwards facing the working fluid 38. The slider mechanism of the driving mechanism 20 is coupled to the pickhead 14 for moving the pickhead 14 relative to streaming fluid jets created by megasonic energy. An inlet tube 40 connected to the bottom of the fluid tank 25 provides a continuous supply of the working fluid 38 to the fluid tank 25. The flow rate of water into the fluid tank 25 need not be high as the water supply serves mainly to flush out the processed working fluid 38 by allowing the fluid carrying saw residue to overflow through the apertures 26 on the side wall of the fluid tank 25. The water supply is also needed for refilling purposes after the processed working fluid 38 is purged out of the fluid tank 25 via an outlet tube 42 connected to the bottom of the fluid tank 25 at an opposite side to the inlet tube 40 at the end of each cleaning cycle.

The cleaning process is facilitated by megasonic energy which is generated by the megasonic transducers 22 when the megasonic transducers 22 are energized and actuated. Megasonic energy generated is propagated away from the megasonic transducers 22 towards the top surface of the working fluid 38 to thereby create streaming fluid jets 44 projecting upwardly at the top surface to contact and clean the semiconductor packages 32. The streaming fluid jets 44 are preferably projected upwards to a height of at least 10 mm or higher above the top surface of the working fluid 38 onto the molded surfaces of the semiconductor packages 32. Unlike prior art U.S. Pat. No. 5,339,842 discussed above where cleaning takes place with the packages immersed in water, the semiconductor packages 32 are located above the water level so that no barrier or medium (in the form of a stagnant layer of working fluid) may affect the transmission of megasonic energy from the megasonic transducers 22 to the semiconductor packages 32. Hence, the acoustic energy is highly concentrated and unidirectional so that the streaming fluid jets 44 carrying this energy impinge onto the molded surfaces of the semiconductor packages 32 to remove the saw residue from the semiconductor packages 32 effectively. The saw residue may then be carried away from the semiconductor packages 32 by the processed working fluid 38.

As the megasonic transducers 22 are exposed directly to the working fluid 38, no energy is lost to any enclosure for the megasonic transducers 22 when the megasonic waves propagate from the megasonic transducers 22. Most of the megasonic vibrational energy from the megasonic transducers 22 is conveyed to the semiconductor packages 32 by the streaming fluid jets 44 so that more effective cleaning is possible. A cross-sectional diameter of each streaming fluid jet 44 is preferably at least 7 mm, corresponding to an effective cleaning zone of such streaming fluid jet 44. Moving the pickhead 14 holding the array of singulated semiconductor packages 32 in the X direction and the tank assembly 24 in the Y direction ensures that the streaming fluid jets 44 cover and clean the entire molded surface of each semiconductor package 32.

Figure 5A:
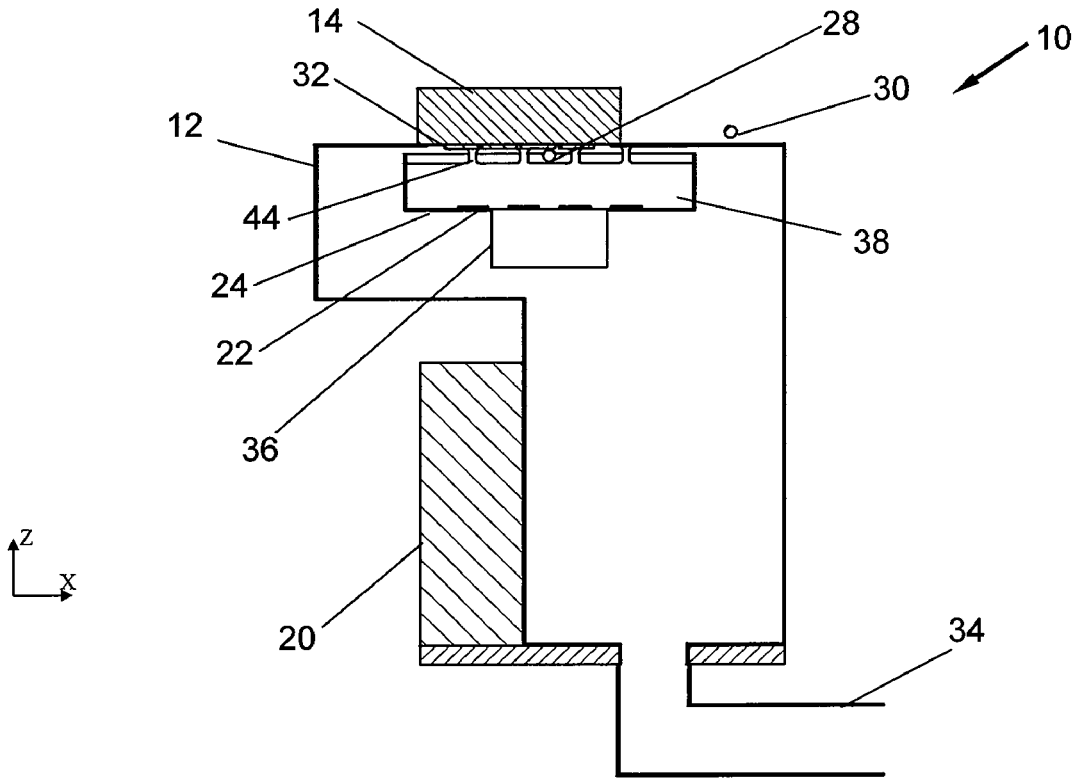
FIGS. 5A to 5D are sectional views of the cleaning apparatus illustrating a cleaning and drying sequence for singulated semiconductor packages according to the preferred embodiment of the invention.

FIGS. 5A to 5D are sectional views of the cleaning apparatus 10 illustrating a cleaning and drying sequence for singulated semiconductor packages 32 according to the preferred embodiment of the invention. In FIG. 5A, the pickhead 14 holding a plurality of semiconductor packages 32 with their molded surfaces facing downwards is lowered to the opening of the slider plate 16. The pickhead 14 may form a seal with the slider plate 16 so as to prevent the working fluid 38 from jetting out of the fluid tank 25. The pickhead 14 moves with the slider plate 16 to a standby position whereat a first column of semiconductor packages 32 is accessible by the effective cleaning zone of the streaming fluid jets 44 for cleaning. As the tank assembly 24 moves along the Y direction, the entire columns of molded surfaces are subjected to the streaming fluid jets 44 for cleaning. The processed working fluid 38 carrying dislodged saw residue overflows from the fluid tank 25, and may flow out to the bottom of the cleaning chamber 12 and into the drainage arrangement 34 for collecting and draining the processed working fluid 38.

Figure 5B:
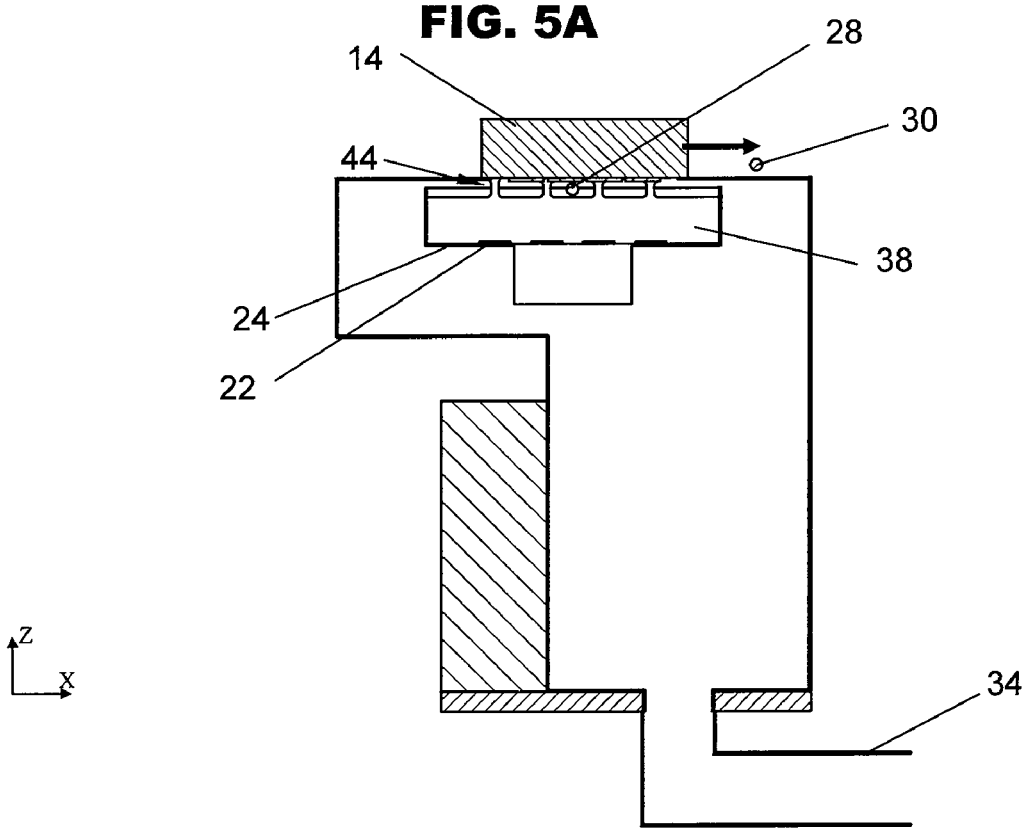

FIG. 5B shows the pickhead 14 moving in the X direction towards the second dry air tube 30 together with the slider plate 16 such that adjacent columns of the semiconductor packages 32 are exposed to the streaming fluid jets 44. These columns of semiconductor packages 32 are cleaned as the tank assembly 24 moves in the Y direction as illustrated in FIG. 5A. The pickhead 14 continues to move in the X direction with the slider plate 16 so that the cycle of cleaning may be repeated until the last column of semiconductor packages 32 is cleaned.

Figure 5C:
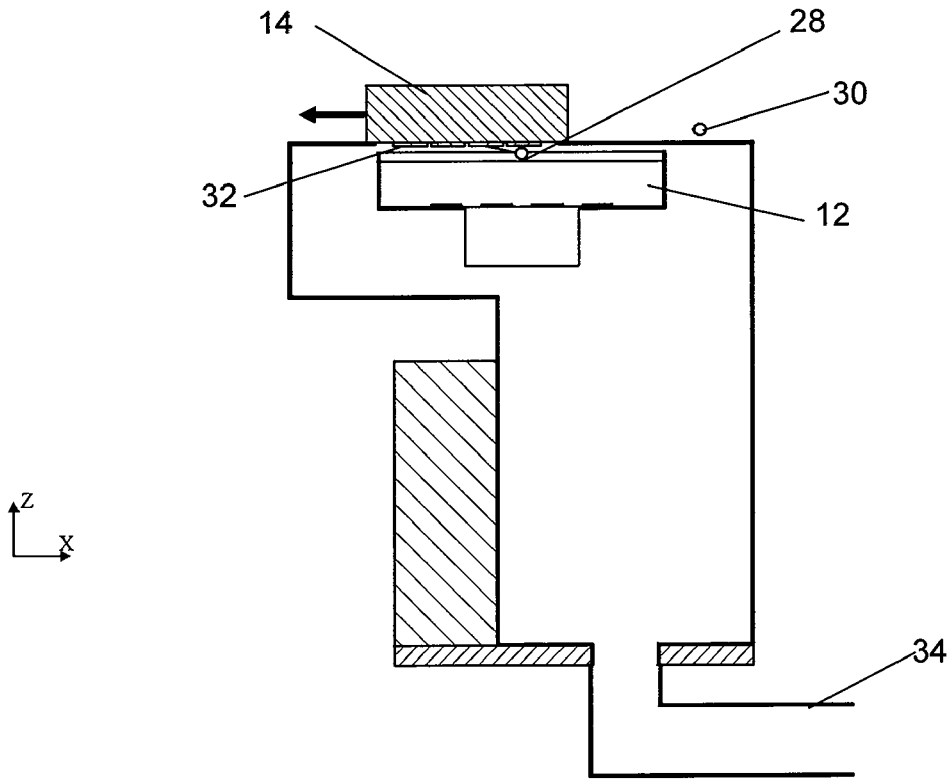

After all the semiconductor packages 32 have been cleaned, the pickhead 14 moves with the slider plate 16 in a reverse direction along the X-axis, as shown in FIG. 5C. The first dry air tube 28 is activated to blow off most of the water on the semiconductor packages 32 while the pickhead 14 returns to the standby position where it was located at the commencement of cleaning. In this way, all the columns of the array of the semiconductor packages 32 may be dried substantially by blow-drying.

Figure 5D:
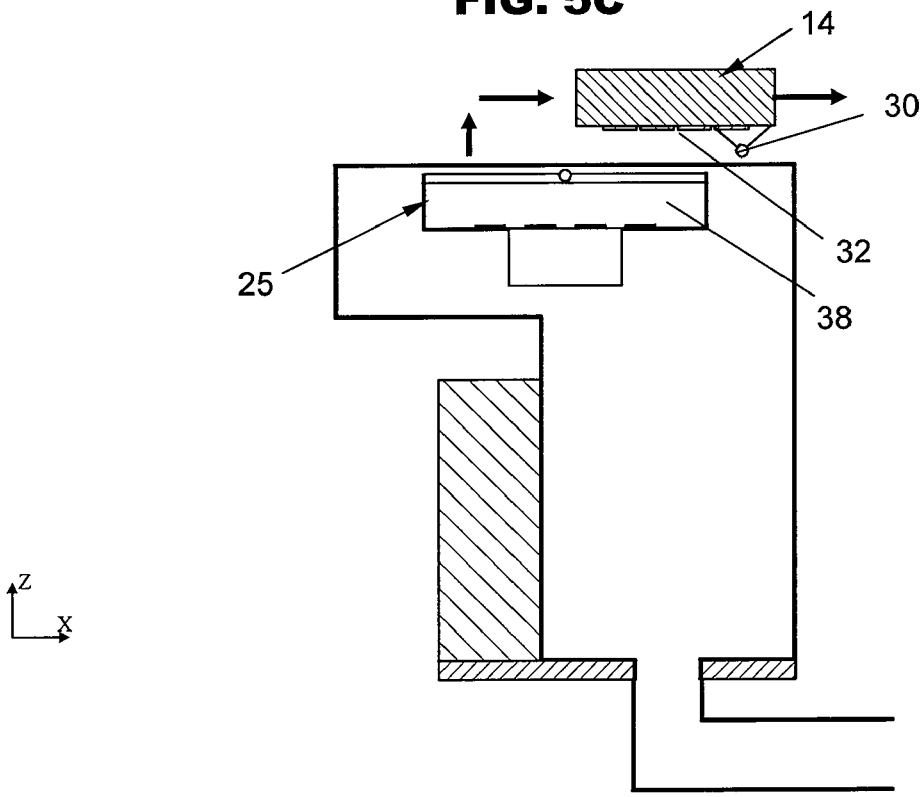

Next as shown in FIG. 5D, the pickhead 14 is raised to a certain height before moving forward in the X direction. This raised height allows the second dry air tube 30 to blow off any remaining water on the molded surfaces of the semiconductor packages 32. The cleansed and dried singulated semiconductor packages 32 may then be moved to a downstream process. Thereafter, the pickhead 14 picks up another batch of semiconductor packages and the cycle of cleaning and drying as described above may be repeated.

During the cleaning process, a continuous flow of working fluid 38 may be supplied to the fluid tank 25 through the inlet tube 40 at the base of the fluid tank 25 at a moderate flow speed. In this way, processed working fluid 38 may leave the fluid tank 25 from the apertures 26 at the top of the fluid tank 25 while carrying the dislodged saw residue from the semiconductor packages 32 out of the fluid tank 25. The processed working fluid 38 is collected at the bottom of the cleaning chamber 12 for drainage. Alternatively, all the processed water fluid 38 inside the fluid tank 25 can be purged and then refilled with fresh fluid right after each cleaning cycle or after a predetermined number of processing cycles when the pickhead 14 is idle. This improves the cleanliness of the working fluid 38.

Figure 6:
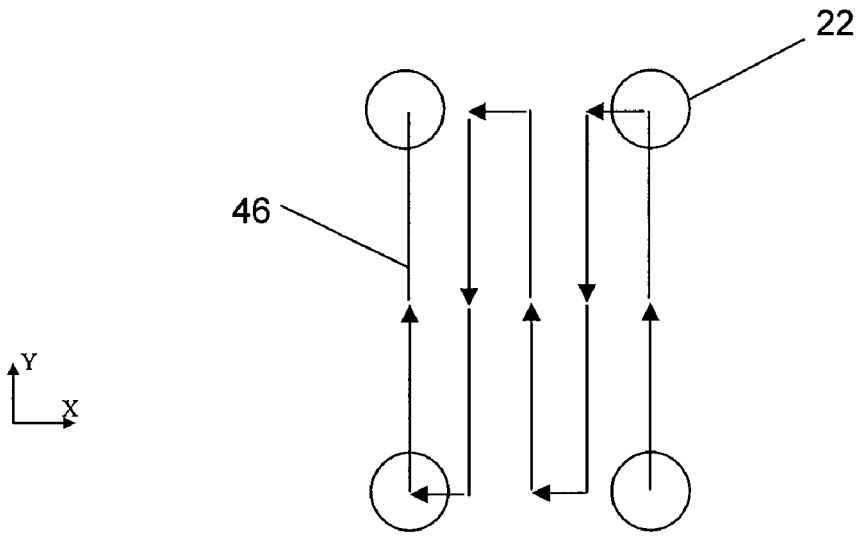
FIG. 6 is a top view of four adjacent megasonic transducers of the cleaning apparatus illustrating a cleaning route moved by an array of semiconductor packages relative to the megasonic transducers during cleaning.

FIG. 6 is a top view of four adjacent megasonic transducers 22 of the cleaning apparatus 10 illustrating a cleaning route 46 moved by an array of semiconductor packages 32 relative to the megasonic transducers 22 during cleaning. The cleaning route is devised to also cover all the areas of the array of semiconductor packages 32 which positions correspond to positions in between adjacent megasonic transducers 22. Since the megasonic transducers 22 are arranged in a two-dimensional array instead of in a single one-dimensional column as in the prior art discussed above, the traveling distance required of the pickhead 14 in the X direction is reduced significantly.

Furthermore, as the megasonic transducers 22 are in direct contact with the working fluid 38 and are not housed within any enclosures such as nozzles as in the prior art, the exposed megasonic transducers 22 can be packed closely to generate a high concentration of multiple streaming fluid jets 44. Therefore, the routing distance of movement required by the pickhead 14 and the tank assembly 24 to cover the entire surface of the semiconductor packages 32 is further reduced to achieve a faster cleaning process as compared to the prior art. As a result, the overall routing distance required for cleaning the semiconductor packages 32 is shorter to achieve a quick and efficient cleaning process.

Figure 7:
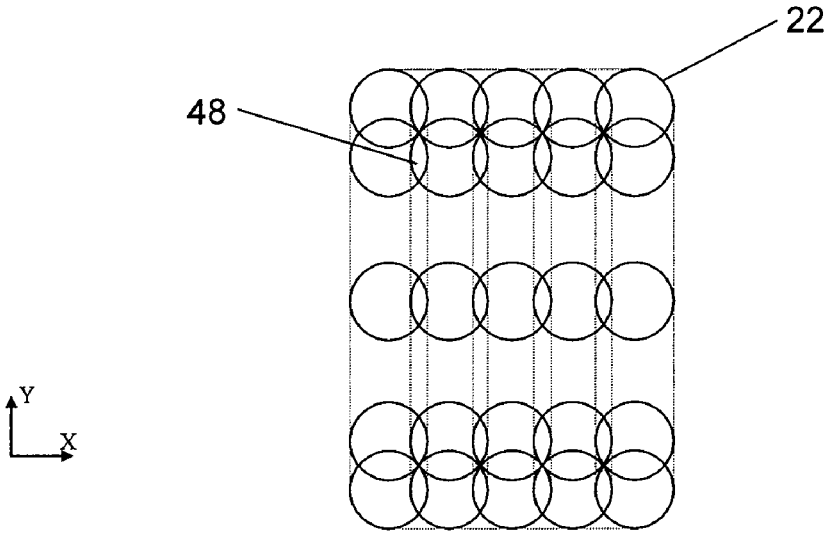
FIG. 7 is a top view of part of the array of megasonic transducers illustrating overlapping cleaning regions attainable from several adjacent megasonic transducers.

FIG. 7 is a top view of part of the array of megasonic transducers 22 illustrating overlapping cleaning regions 48 which are attainable from several adjacent megasonic transducers 22. The routes of the streaming fluid jets 44 overlap at some areas to ensure the whole surface areas of all the semiconductor packages 32 are cleaned.

It should be appreciated that the megasonic streaming fluid jets 44 generated by the cleaning apparatus 10 in accordance with the preferred embodiment of the invention provides an effective and fast cleaning method for the removal of saw residue from the singulated semiconductor packages 32. After the saw residue is removed, it is carried away by the processed working fluid 38 which leaves the fluid tank 25 through the apertures 26. Hence, the saw residue will not adhere to the singulated semiconductor packages 32 after cleaning.

The megasonic energy carried in the streaming fluid jets 44 is unidirectional and concentrated since there is no loss of energy to the wall of any housing enclosing the megasonic transducers 22 as the megasonic energy generated by the megasonic transducers 22 propagates through the working fluid 38. The semiconductor packages 32 are thus subjected to strong acoustic jets which permit effective and faster cleaning. Additionally, the two-dimensional arrayed arrangement of the megasonic transducers 22 as well as having more megasonic transducers 22 packed closely together reduces routing time for cleaning the entire surface area of the semiconductor packages 32. There is also less chance of dislocating the singulated semiconductor packages 32 as there is no mechanical contact with the semiconductor packages 32 by solid mechanical devices such as brushes, and the pressure and speed of the streaming fluid jets 44 are much lower than the fluid jet pressure adopted by other cleaning methods.

The invention described herein is susceptible to variations, modifications and/or additions other than those specifically described and it is to be understood that the invention includes all such variations, modifications and/or additions which fall within the spirit and scope of the above description.

The invention claimed is:

1. An apparatus for cleaning electronic packages, the apparatus comprising:

a tank configured to contain cleaning fluid;

a holder positioned above the tank and configured to support the electronic packages above a top surface of the cleaning fluid such that the electronic packages face the cleaning fluid;

a plurality of rows of acoustic energy generators positioned immersed in the cleaning fluid and configured to generate and to propagate acoustic energy towards the top surface of the cleaning fluid such that the acoustic energy creates streaming fluid jets projecting upwardly from the top surface of the cleaning fluid to contact and clean the electronic packages supported on the holder while the electronic packages are still supported above the top surface of the cleaning fluid, wherein each jet of the streaming fluid jets is distinguishable from the other streaming fluid jets.

2. The apparatus as claimed in claim 1, further comprising a driving device configured to direct the streaming fluid jets to clean the electronic packages by driving relative movement between the streaming fluid jets and the holder.

3. The apparatus as claimed in claim 2, wherein the driving device comprises a slider mechanism coupled to the holder, the slider mechanism configured to move the holder relative to the streaming fluid jets.

4. The apparatus as claimed in claim 3, further comprising a slider plate configured to receive the holder to form a seal with the holder against the streaming fluid jets.

5. The apparatus as claimed in claim 3, wherein the slider mechanism is configured to move the holder along a first direction and the driving device further comprises a separate driving mechanism coupled to the tank and configured to move the tank in a direction orthogonal to the first direction.

6. The apparatus as claimed in claim 2, wherein the driving device is configured to maintain all the electronic packages positioned within boundaries of the streaming fluid jets.

7. The apparatus as claimed in claim 1, further comprising a chamber configured to house the tank and positioned and configured to collect cleaning fluid overflowing from the tank.

8. The apparatus as claimed in claim 7, further comprising a drainage arrangement positioned at a base of the chamber and configured to collect and to drain cleaning fluid.

9. The apparatus as claimed in claim 1, further comprising a dry air tube positioned on the tank and configured to dry the electronic packages supported on the holder by blowing air onto the electronic packages.

10. The apparatus as claimed in claim 9, further comprising a second dry air tube positioned away from the tank and configured to dry the electronic packages on the holder by blowing air onto the electronic packages.

11. The apparatus as claimed in claim 1, wherein the acoustic energy generators are arranged close to one another to generate a high concentration of the streaming fluid jets.

12. The apparatus as claimed in claim 1, wherein the tank includes a bottom enclosure and the acoustic energy generators are mounted at the bottom enclosure.

13. The apparatus as claimed in claim 12, further comprising a control circuit for the acoustic energy generators; and a housing mounted to an underside of the bottom enclosure of the tank close to the acoustic energy generators and configured to enclose the control circuit.

14. The apparatus as claimed in claim 1, wherein each generator of the acoustic energy generators is configured to be in direct contact with the cleaning fluid.

15. The apparatus as claimed in claim 1, wherein a cross-sectional diameter of each streaming fluid jet generated by each generator of the acoustic energy generators is at least 7 mm measured at the electronic packages.

16. The apparatus as claimed in claim 1, wherein the acoustic energy generators are configured to project the streaming fluid jets upwards from the top surface of the cleaning fluid to a height of at least 10 mm.

17. The apparatus as claimed in claim 1, further comprising a plurality of slots positioned along a top end of the tank and configured to permit the cleaning fluid to flow out of the tank through the slots.

18. The apparatus as claimed in claim 1, wherein the tank includes a bottom enclosure, the apparatus further comprising:

an inlet tube connected to the bottom enclosure of the tank and configured to provide a continuous supply of cleaning fluid to the tank; and an outlet tube connected to the bottom enclosure of the tank at an opposite side of the tank from the inlet tube and configured to remove processed cleaning fluid from the tank.

19. The apparatus as claimed in claim 1, wherein the rows of the plurality of rows of acoustic energy generators are positioned so as to form a two dimensional arrangement of acoustic energy generators.

* * * * *